US006158133A

United States Patent [19]

Carlson et al.

[11] Patent Number: 6,158,133

[45] Date of Patent: Dec. 12, 2000

[54] OVAL CUTTER

[75] Inventors: Christopher Carlson, Wausau; Robert Cornell; Steve Suchanek, both of Schofield, all of Wis.

[73] Assignee: Fiskars Inc., Madison, Wis.

[21] Appl. No.: 09/220,309

[22] Filed: Dec. 23, 1998

[51] Int. Cl.[7] ..... B43L 9/00; B26B 3/00; B26D 7/00

[52] U.S. Cl. ..... 33/27.01; 33/30.1; 33/30.6; 33/31; 30/300; 30/310; 83/772; 83/592; 83/829

[58] Field of Search ..... 33/18.1, 27.01, 33/27.06, 27.07, 30.1, 30.2, 30.6, 31; 30/300, 310; 83/771, 772, 565, 743, 829, 592

[56] References Cited

U.S. PATENT DOCUMENTS

| | | | |
|---|---|---|---|
| 179,039 | 6/1876 | McAdams | 33/27.12 |
| D. 243,117 | 1/1977 | Green | D15/127 |
| 386,619 | 7/1888 | Wilson et al. | 33/31 |

(List continued on next page.)

FOREIGN PATENT DOCUMENTS

| | | |
|---|---|---|
| 864171 | 6/1978 | Belgium . |
| 903666 | 3/1986 | Belgium . |
| 2250561 | 1/1998 | Canada . |
| 1209394 | 8/1997 | China . |
| 0410058 | 1/1991 | European Pat. Off. . |
| 733434 | 10/1996 | European Pat. Off. . |
| 955133 | 5/1998 | European Pat. Off. . |
| 979700 | 8/1998 | European Pat. Off. . |
| 2441468 | 7/1980 | France . |
| 2612113 | 9/1988 | France . |
| 81840 | 7/1970 | German Dem. Rep. . |
| 1265398 | 4/1963 | Germany . |
| 2621687 | 5/1976 | Germany . |
| 2511081 | 9/1976 | Germany . |
| 2522188 | 11/1976 | Germany . |
| 2815383 | 10/1979 | Germany . |
| 3235823 | 5/1983 | Germany . |
| 3343370 | 5/1984 | Germany . |
| 3837449 | 11/1988 | Germany . |
| 3923785 | 1/1991 | Germany . |
| 29707792 | 5/1997 | Germany . |
| 58-172240 | 10/1983 | Japan . |
| 02293200 | 12/1990 | Japan . |
| 03101999 | 4/1991 | Japan . |
| 03244600 | 10/1991 | Japan . |

(List continued on next page.)

OTHER PUBLICATIONS

Matmate Oval/Circle Mat Cutter, Part No. 04–924, by the Fletcher–Terry Company, 65 Spring Lane, Farmington, CT 06032, No Date Given.

NT Circle Cutter C–1500P, by NT Incorporated, No Date Given.

NT Circle Cutter C–2500P, by NT Incorporated, No Date Given.

Ellipsographs of De l'Hospital, http://155.185.1.61/labmat/hospitin.htm, p. 1 of 1, Jun. 5, 2000.

Ellipsograph of Van Schooten, http://155.185.1.61/labmat/Vanschin.htm, p. 1 of 1, Jun. 5, 2000.

*Primary Examiner*—Randy W. Gibson

*Attorney, Agent, or Firm*—Michael D. Rechtin; Foley & Lardner

[57] ABSTRACT

An apparatus for rendering ovals of adjustable sizes and ellipticity upon various materials. An oval cutter comprises a clickerplate for adjusting the ellipticity of ovals in a single movement. The clickerplate can be rotated about a base using a knob mounted on the clickerplate. One embodiment of this invention comprises a storage compartment in the knob which can hold, for example, extra blades. A further embodiment of this invention comprises an arm that translates through the clickerplate and a swivel plate used for setting the overall size of the oval by locking the arm at a set length. In yet a further embodiment of this invention, ovals can be rendered in either a clockwise or a counterclockwise direction and an arrow can indicate the direction in which the apparatus is set to render ovals.

40 Claims, 4 Drawing Sheets

U.S. PATENT DOCUMENTS

| | | | |
|---|---|---|---|
| 494,864 | 4/1893 | Huston | 83/565 |
| 517,522 | 4/1894 | King | 33/31 |
| 572,320 | 12/1896 | Stuparich | 83/565 |
| 658,710 | 9/1900 | Forker | 83/565 |
| 658,711 | 9/1900 | Forker | 83/565 |
| 660,211 | 10/1900 | Durkel | 30/310 |
| 697,997 | 4/1902 | Drinkaus | 83/523 |
| 701,828 | 6/1902 | Arnold | 30/310 |
| 705,576 | 7/1902 | Forker | 83/565 |
| 742,047 | 10/1903 | Moehle | 33/27.12 |
| 973,047 | 10/1910 | Jeter | 33/31 |
| 1,007,910 | 11/1911 | Baker | 33/30.2 |
| 1,010,292 | 11/1911 | McKinstry | 33/31 |
| 1,031,780 | 7/1912 | Fine | 33/31 |
| 1,326,260 | 12/1919 | Hardebeck | 425/293 |
| 1,391,530 | 9/1921 | Bustillo y Diego | 33/31 |
| 1,470,168 | 10/1923 | Jepsen | 33/31 |
| 1,614,772 | 1/1927 | Bambini et al. | 30/286 |
| 1,806,484 | 5/1931 | Michaud | 30/293 |
| 1,837,912 | 12/1931 | Mann | 33/31 |
| 2,215,216 | 9/1940 | Gits et al. | 30/162 |
| 2,458,208 | 1/1949 | Ruger | 33/31 |
| 2,494,557 | 1/1950 | Irick | 33/31 |
| 2,512,786 | 6/1950 | Borg | 33/27 |
| 2,872,732 | 2/1959 | Arrowood | 30/314 |
| 2,908,972 | 10/1959 | Nitenson | 30/293 |
| 2,925,655 | 2/1960 | De Beek | 33/31 |
| 3,032,893 | 5/1962 | Debeh | 35/13 |
| 3,165,130 | 1/1965 | Sanders | 144/33 |
| 3,562,915 | 2/1971 | Brown | 33/31 |
| 3,621,574 | 11/1971 | Yanke et al. | 30/290 |
| 3,820,245 | 6/1974 | Yozzo | 33/27 |
| 3,834,028 | 9/1974 | Okada et al. | 33/30 |
| 3,845,676 | 11/1974 | Pierce | 82/1.3 |
| 3,867,636 | 2/1975 | Miyahara | 250/445 |
| 4,048,724 | 9/1977 | Keaver | 33/31 |
| 4,112,793 | 9/1978 | Pierce | 82/1.3 |
| 4,148,144 | 4/1979 | Stiles | 33/33 |
| 4,176,452 | 12/1979 | Duggins et al. | 30/293 |
| 4,222,169 | 9/1980 | Lockwood | 30/286 |
| 4,233,736 | 11/1980 | Duggins et al. | 30/293 |
| 4,244,106 | 1/1981 | Pierce | 33/31 |
| 4,306,598 | 12/1981 | Peot | 144/136 |
| 4,407,074 | 10/1983 | Ledbetter | 33/27 |
| 4,445,275 | 5/1984 | Dubrow | 33/30 |
| 4,567,927 | 2/1986 | Plamann | 144/134 |
| 4,624,057 | 11/1986 | Hursey | 33/570 |
| 4,649,647 | 3/1987 | Kaulfuss | 30/293 |
| 4,691,604 | 9/1987 | Carmichael | 83/164 |
| 4,773,798 | 9/1988 | Gaster et al. | 408/102 |
| 4,782,730 | 11/1988 | Picone et al. | 83/745 |
| 4,790,222 | 12/1988 | Morgan | 82/1.3 |
| 4,858,322 | 8/1989 | Kluga | 30/310 |
| 4,934,054 | 6/1990 | Morozumi | 30/293 |
| 5,014,584 | 5/1991 | Kozyrski et al. | 83/464 |
| 5,058,282 | 10/1991 | Coll | 33/31 |
| 5,099,727 | 3/1992 | Kozyrski et al. | 82/1.3 |
| 5,123,170 | 6/1992 | Enrique | 33/30.1 |
| 5,189,800 | 3/1993 | Morita et al. | 33/30.1 |
| 5,233,748 | 8/1993 | Logan et al. | 30/310 |
| 5,430,946 | 7/1995 | Peters et al. | 33/31 |
| 5,526,573 | 6/1996 | Peters et al. | 33/31 |
| 5,555,631 | 9/1996 | Houston | 33/31 |
| 6,052,909 | 4/2000 | Gardner | 30/310 |

FOREIGN PATENT DOCUMENTS

| | | |
|---|---|---|
| 04164698 | 6/1992 | Japan . |
| 080309220 | 5/1995 | Japan . |
| 08090988 | 4/1996 | Japan . |
| 09300274 | 11/1997 | Japan . |
| 10035182 | 2/1998 | Japan . |
| 2038926 | 6/1992 | Russian Federation . |
| 2112630 | 5/1996 | Russian Federation . |
| 2066599 | 9/1996 | Russian Federation . |
| 547362 | 8/1977 | U.S.S.R. . |
| 640788 | 1/1979 | U.S.S.R. . |
| 742397 | 6/1980 | U.S.S.R. . |
| 946815 | 8/1982 | U.S.S.R. . |
| 992439 | 1/1983 | U.S.S.R. . |
| 1282987 | 1/1987 | U.S.S.R. . |
| 979278 | 2/1978 | United Kingdom . |
| 2075405 | 11/1981 | United Kingdom . |
| 2242147 | 1/1991 | United Kingdom . |
| 2297526 | 8/1996 | United Kingdom . |
| 200012275 | 1/1999 | WIPO . |

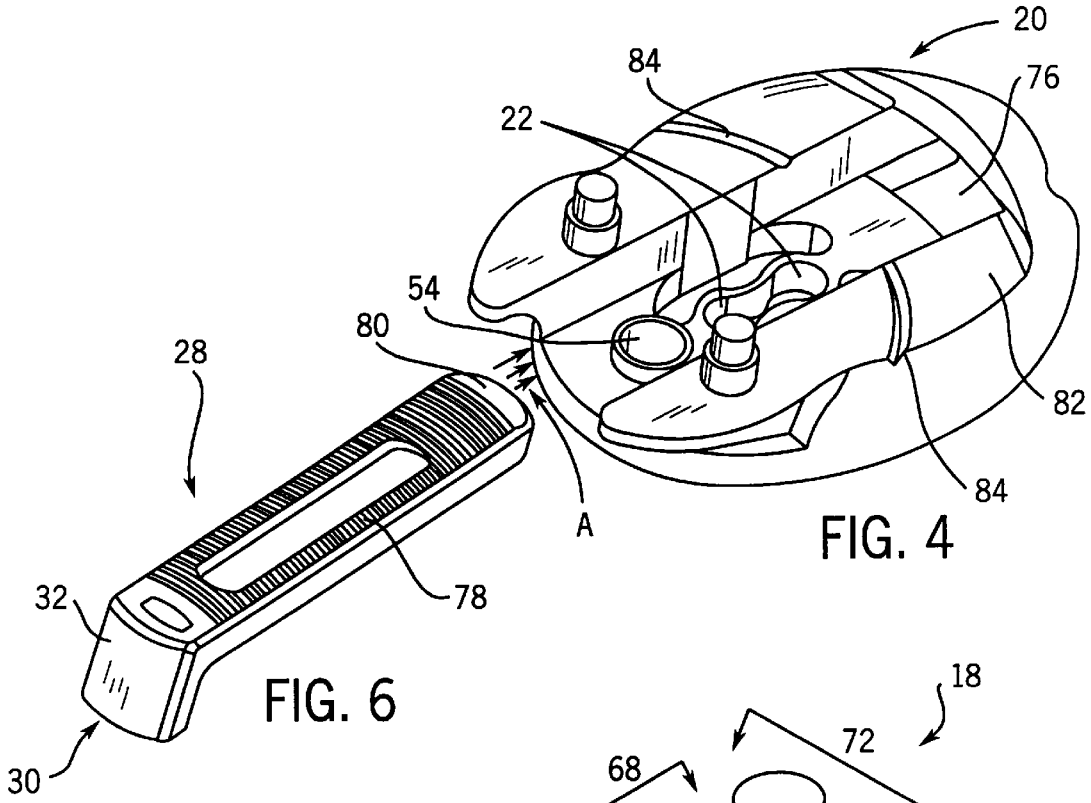
FIG. 4
FIG. 6
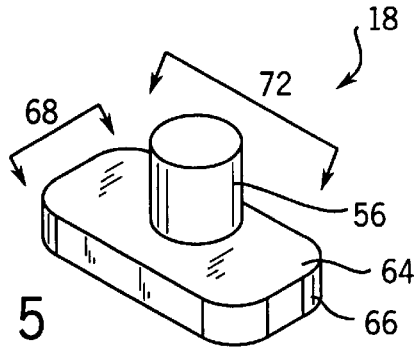
FIG. 5
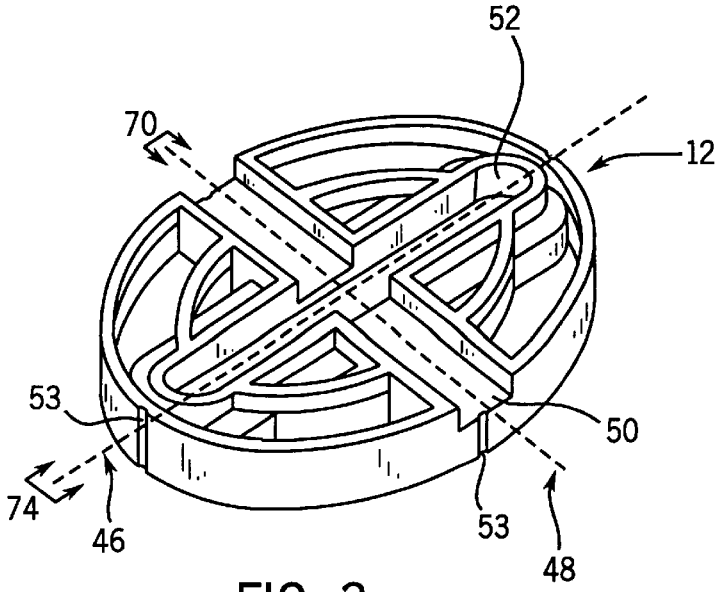
FIG. 3

OVAL CUTTER

FIELD OF THE INVENTION

The present invention relates to devices and apparatus for the rendering of ovals upon a material. In particular, the invention relates to such apparatus having more than one position foci adjustment.

BACKGROUND OF THE INVENTION

In the fabrication of artwork mats, craft items and numerous other applications, devices are often used for rendering an oval shape upon a material. The material is often in the form of flat sheets of a substance such as paper, mat board, sheet plastic, and the like. The term "rendering" may include, but is not limited to, operations such as cutting, edge trimming, surface marking with an implement, such as a pen or pencil, or inscribing.

In addition to drafting templates, devices are well known in the prior art for rendering ovals upon a material. Typically, such prior art devices, which allow the user to adjust the foci of the oval, involve points of adjustment for changing the overall size of the oval, the width-to-length ratio (or ellipticity) of the oval and the angle of the blade or marking device. However, such adjustments typically require the user to manually loosen the adjustment components, fix the adjustment components in the desired position and then manually tighten the adjustment components once they are affixed in the desired position. Fumbling with knobs and other adjustment devices becomes very tedious with more than one step involved.

It is therefore an object of the present invention to provide a novel device for rendering ovals on material.

It is another object of this invention to provide a novel device with more than one foci adjustment for rendering ovals on material.

It is another object of this invention to provide a novel device for rendering ovals on material wherein the foci adjustment comprises a single and continuously variable movement.

It is another object of this invention to provide a novel device for rendering ovals of an infinite variety of sizes and width-to-length ratios, or ellipticity, on material.

It is another object of this invention to provide a novel device for rendering ovals on material wherein the device comprises a swivel plate for adjustably locking the length of an arm for determining the overall size of the oval.

It is another object of this invention to provide a novel device for rendering ovals on material wherein the device comprises a storage compartment in the device for storing, for example, extra blades.

It is another object of this invention to provide a novel device for rendering ovals on material wherein the device is capable of both drawing and cutting ovals.

It is another object of this invention to provide a novel device for rendering ovals on material wherein the device is capable of simultaneously drawing and cutting ovals.

It is another object of this invention to provide a novel device for rendering ovals on material wherein the device can rotate in either a clockwise or a counterclockwise direction.

It is another object of this invention to provide a novel device for rendering ovals on material wherein the device comprises an indicator for denoting the direction in which the blade is set to cut.

It is another object of this invention to provide a novel device for rendering ovals on material wherein the device comprises compass points for improving alignment of the ovals on the material. It is another object of this invention to provide a novel device for rendering ovals on material wherein an operating element of the device is located below a top surface of the device.

It is another object of this invention to provide a novel device for rendering ovals on material wherein the device comprises a slot and a channel disposed within the same plane.

It is another object of this invention to provide a novel device for rendering ovals on material wherein the device does not require a space between a slot and a channel in which an armature is disposed.

Other objects and advantages of the invention will become apparent by review of the detailed description of preferred embodiments.

SUMMARY OF THE INVENTION

The invention is directed to an apparatus for rendering ovals of adjustable sizes and ellipticity upon various materials. The apparatus can comprise a clickerplate device for easy user adjustment of the ellipticity. The clickerplate also allows an infinite range of variable foci selection. The clickerplate further allows the adjustment to be made in a single movement for ease of use and also enables reduction in adjustment errors. The structural components for adjusting the ellipticity can be located below a top surface of the apparatus to avoid unintentional adjustments during use.

The clickerplate comprises a plurality of receptacles adjacent one another at various distances from a set pivotal axis on the clickerplate. The receptacles provide potential pivot points for insertion of a glide member pivotal component of a glide member. The greater the distance between a set pivotal member and the glide member pivotal component, the more oblong or eccentric a resulting oval will be.

The glide member has a structure which enables gliding through a channel extending the width of a base of the apparatus. The base can further comprise a slot extending the length of the base. The set pivotal member can extend downward through a set pivotal aperture on the clickerplate and downward into the slot and rotatably slide through the slot, allowing the clickerplate to rotate about the base. In one embodiment of the invention, the channel is co-planar with the slot. In another embodiment of the invention, the channel and the slot intersect.

Another feature of the apparatus that reduces adjustment error is a swivel plate which can be used for setting the overall size of the oval. The swivel plate is used in conjunction with an arm that translates through the clickerplate, wherein the arm can be adjusted and locked at a set length by turning the swivel plate and fitting it into a groove on the arm.

The apparatus can further comprise a knob mounted on the clickerplate. The knob can be rotated to render ovals, rather than having to hold the base with one hand while using the other hand to turn the end of the arm as is required in other oval cutters. The apparatus can further comprise a storage compartment in the knob for holding, for example, extra blades.

The apparatus can be adjusted to render ovals in either a clockwise or a counterclockwise direction. The apparatus can further comprise an arrow to indicate the direction in which the apparatus is set to render ovals.

The above described objects and embodiments are set forth in the following description and illustrated in the drawings described hereinbelow.

BRIEF DESCRIPTION OF THE DRAWINGS

FIG. 3 is a perspective view of a base of the oval cutter;

FIG. 4 is a perspective view of a clickerplate for adjusting the ellipticity of ovals rendered by the oval cutter;

FIG. 5 is a perspective view of a glide member of the oval cutter;

FIG. 6 is a perspective view of an arm for adjusting the overall size of ovals rendered by the oval cutter.

DETAILED DESCRIPTION OF THE PREFERRED EMBODIMENTS

Figure 1:
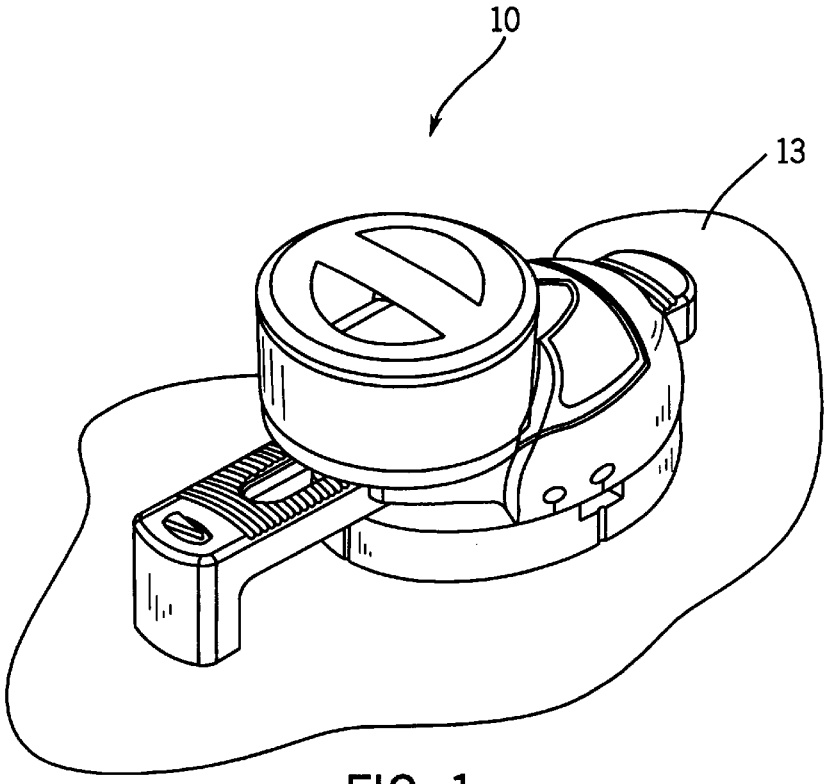
FIG. 1 is a perspective view of one of the preferred embodiments of an oval cutter.
Figure 2:
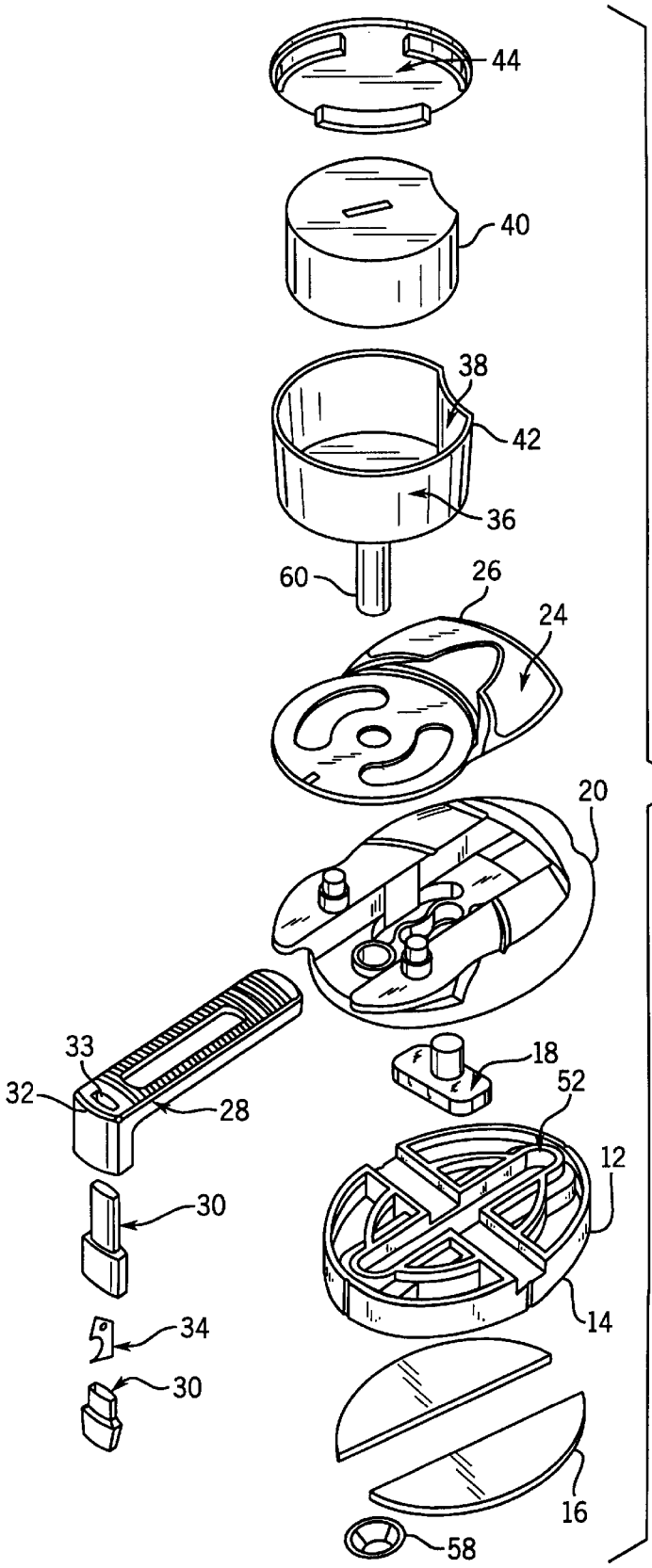
FIG. 2 is an exploded view of the oval cutter of FIG. 1.

A preferred embodiment of an oval cutter 10 of the invention is shown in FIGS. 1 and 2. As shown in FIG. 2, the oval cutter 10 includes pads 16 which are attached to a bottom surface 14 of a base 12 in order to hold the base 12 in place on a surface 13 upon which an oval is being rendered (see FIG. 1). The pads 16 in FIG. 2 can comprise rubber or other material with a coefficient of friction sufficiently high enough to hold the base 12 in place on various types of the surface 13. The surface 13 can include, for example, paper, mat board, sheet plastic, and numerous other types of material. A clickerplate 20 for adjusting ellipticity of ovals is rotatably attached to the base 12 with a set pivotal member 60 that extends through the clickerplate 20 and the base 12. A glide member 18 (see FIGS. 2 and 5) is engaged to the clickerplate 20 (see FIGS. 2 and 4) in a receptacle 22 (best seen in FIG. 4) of the clickerplate 20 and is free to glide through a channel 50 (see FIG. 3) in the base 12.

Figure 8:
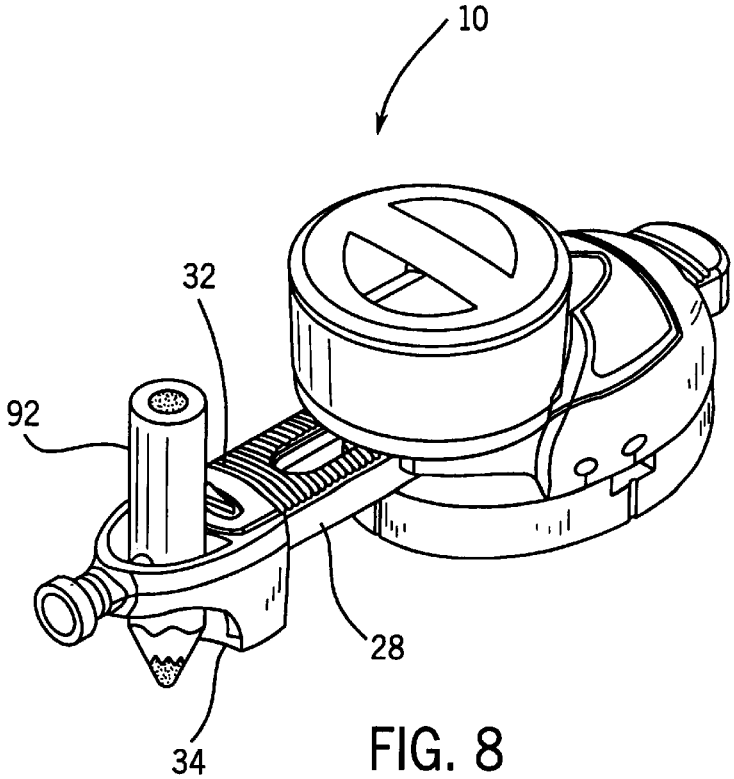
FIG. 8 is a perspective view of an alternate embodiment of an oval cutter comprising means for both cutting and drawing ovals.
Figure 7A:
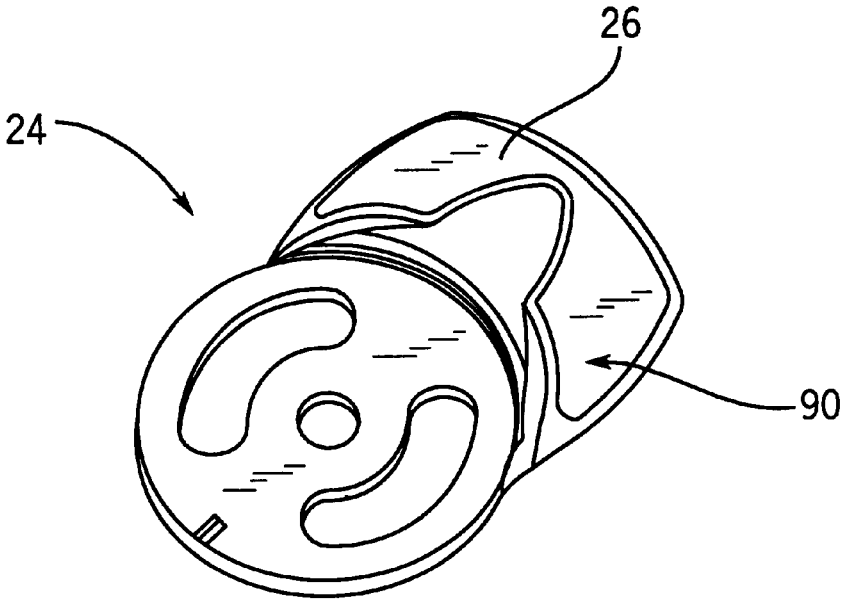
FIG. 7*a* is a perspective view of a top surface of a swivel plate of the oval cutter.

In a preferred embodiment, a swivel plate 24 (see FIGS. 2, 7*a* and 7*b*) comprises a top surface 26 of the oval cutter 10. The swivel plate 24 is used in conjunction with an arm 28 that translates through the clickerplate 20 (see FIGS. 4 and 6) to adjust the overall size of ovals. A blade holder 30 (see FIGS. 2 and 6) is attached to one end 32 of the arm 28. A blade 34 can be inserted in the blade holder 30, or, alternatively, a marking device (not shown), such as a pencil, can be attached to end 32 of the arm 28 in place of the blade 34 and the blade holder 30. In an alternate embodiment (see FIG. 8), both a blade 34 and a marking device 92 can be attached to the end 32 of the arm 28 to simultaneously cut and draw ovals.

As shown in FIG. 2, a knob 36 for rotating the arm 28 can be operatively attached to the clickerplate 20. The knob 36 can be rotated to render ovals, rather than having to hold the base 12 with one hand while using another hand to turn the end 32 of the arm 28, as is required in other oval cutters. The knob 36 can be ergonomically shaped for enhanced comfort for a user's hand. A preferred embodiment of the oval cutter 10 comprises a storage compartment 38 within the knob 36 which can be used for holding, for example, extra ones of the blades 34. In addition, a blade storage holder 40 can be located in the storage compartment 38 for maintaining spare ones of the blades 34. The blade storage holder 40 is preferably constructed from a cushioning material, such as foam. A cap 44 is fitted to a top 42 of the storage compartment 38.

FIG. 3 is a perspective view of the base 12. A major axis 46 spans a length of the base 12, and a minor axis 48 spans a width of the base 12. The base 12 comprises a slot 52 extending along the major axis 46 and the channel 50 extending along the minor axis 48. The slot 52 and the channel 50 are preferably co-planar and intersect one another. Compass points 53 are located on the major axis 46 and on the minor axis 48 for improving alignment of ovals on the surface 13.

FIG. 4 is a perspective view of the clickerplate 20 for adjusting the ellipticity of ovals rendered by the oval cutter 10. The clickerplate 20 comprises a plurality of receptacles 22 interconnected and adjacent one another at various distances from a set pivotal aperture 54 on the clickerplate 20. The receptacles 22 enable providing a range of potential pivot points for insertion of a glide member pivotal component 56 of the glide member 18 (see FIG. 5). The greater the distance between the set pivotal aperture 54 of FIG. 4 and the glide member pivotal component 56 of FIG. 5, the more oblong the resulting oval will be. The glide member 18 can be moved from one of the receptacles 22 to an adjacent one of the receptacles 22 in a single movement, thereby reducing probability of adjustment errors that would occur in a typical three-step process of loosening an adjustment member, moving the adjustment member to a desired location, and re-tightening the adjustment member. In a preferred embodiment (see FIG. 2), the clickerplate 20 is located below the top surface 26 of the oval cutter 10 to avoid unintentional adjustments during use. The set pivotal member 60 extends from the knob 36 through the set pivotal aperture 54 on the clickerplate 20 and downward into the slot 52 and rotatably slides through the slot 52 allowing the clickerplate 20 to rotate about the base 12. A push nut 58 (shown in FIG. 2), or similar fastener, is attachable to the set pivotal member 60 below the slot 52 in order to securely and rotatably attach the clickerplate 20 to the base 12.

FIG. 5 is a perspective view of the glide member 18 wherein the glide member pivotal component 56 extends from a top surface 64 of the glide member 18 and is rotatably secured within one of the receptacles 22 of the clickerplate 20. A body 66 of the glide member 18 glides through the channel 50 (see FIG. 3) on the base 12. Therefore, width 68 of the body 66 is less than width 70 of the channel 50. In order to maintain the glide member 18 within the channel 50, length 72 of the body 66 is preferably longer than width 74 of the slot 52 over which the glide member 18 passes.

Figure 7B:
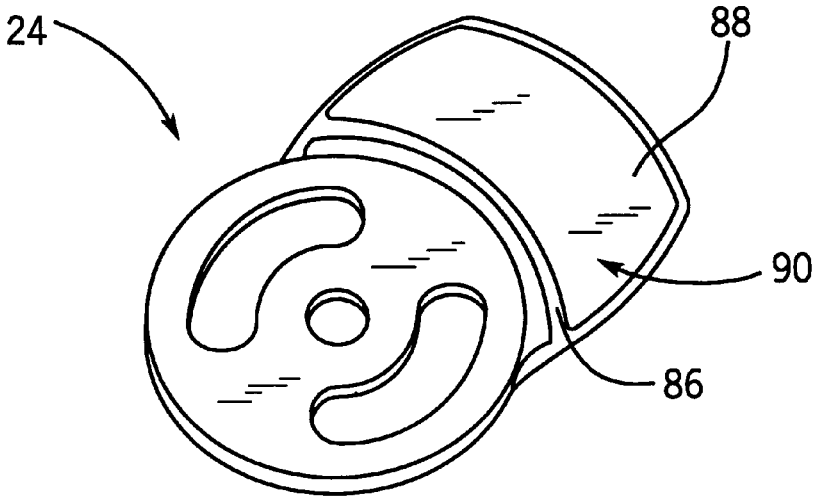
FIG. 7*b* is a perspective view of a bottom surface of the swivel plate of the oval cutter.

FIG. 6 is a perspective view of the arm 28, described in part hereinbefore, which translates through a passageway 76 in the clickerplate 20 (see FIG. 4 in conjunction with FIG. 6). The farther (radially) the end 32 holding the blade 34 is from the base 12, the larger the overall size of rendered ovals will be. The arm 28 also has a series of grooves 78 along a top surface 80. As shown in FIG. 4, a top surface 82 of the clickerplate 20 possesses a similar groove 84 which can be placed into alignment with any of the grooves 78 on the arm 28. The swivel plate 24 (FIGS. 7*a* and 7*b*) comprises a protrusion 86 on an under side 88 of the swivel plate 24 (FIG. 7*b*). The protrusion 86 matingly slides in and out of the groove 84 on the top surface 82 of the clickerplate 20. Furthermore, a portion 90 of the swivel plate 24 with the protrusion 86 can be turned away from the arm 28 (see FIG. 6), thereby allowing the arm 28 to slide back and forth in the passageway 76 of the clickerplate 20 of FIG. 4 (see directional arrows, A). The length of the arm 28 protruding from the clickerplate 20 is representative of the distance between the blade 34 (or marker) shown in FIG. 2 and the base 12.

Once the blade 34 is at a desired distance for providing a desired size oval, the portion 90 of the swivel plate 24 (see FIGS. 7*a* and 7*b*) having the protrusion 86 can be turned to rest on the arm 28, thereby sliding the protrusion 86 into a particular one of the grooves 78 on the arm 28 and locking the arm 28 into a desired position. Unlike screw mechanisms, the grooves 78 and 84 and the protrusion 86, acting as a locking mechanism, actually lock into a set position and cannot be easily loosened, thereby reducing chances of error arising from adjustment.

In yet another embodiment of the invention, the blade 34 in the oval cutter 10 can be adjusted to render ovals in either a counterclockwise (see position of the blade 34 in FIG. 2) or a clockwise direction (wherein position of the blade 34 in FIG. 2 is rotated 180° about a vertical axis). In this embodiment, the oval cutter 10 comprises an indicator 33 (see FIG. 2) for indicating the direction in which the blade 34 is set to cut.

While preferred embodiments have been shown and described, it should be understood that changes and modifications can be made therein without departing from the invention in its broader aspects. Various features of the invention are defined in the following claims.

What is claimed is:

1. An apparatus for the rendering of ovals of adjustable ellipticity upon a material having a surface, the apparatus comprising:

a base having a major axis and a minor axis;

a glide member operatively connected to the base;

a clickerplate operatively connected to the base, wherein the clickerplate comprises a plurality of receptacles for receiving the glide member in a rotatably fixed position relative to each receptacle;

an arm operatively connected to the clickerplate; and a marking device operatively connected to the arm.

2. The apparatus of claim 1 wherein the marking device is selected from the group consisting of a cutting blade and a writing implement.

3. The apparatus of claim 1 wherein the marking device comprises a cutting blade and a writing implement.

4. The apparatus of claim 1 wherein the base comprises at least one compass point on each of the major axis and the minor axis.

5. The apparatus of claim 1 wherein the base comprises a channel extending along the minor axis and the glide member is disposed to glide through the channel.

6. The apparatus of claim 1 wherein the base comprises a slot extending along the major axis and a pin extends downward from the clickerplate into the slot wherein the pin rotatably slides through the slot, thereby moving the clickerplate about the base.

7. The apparatus of claim 6 wherein the base comprises a channel extending along the minor axis co-planar with the slot.

8. The apparatus of claim 6 wherein the base comprises a channel extending along the minor axis, thereby intersecting the slot.

9. The apparatus of claim 1 wherein the arm is aligned structurally to translate through the clickerplate.

10. The apparatus of claim 9 further comprising a swivel plate for adjustably locking the arm at a set length.

11. The apparatus of claim 1 further comprising a knob mounted on the clickerplate.

12. The apparatus of claim 11 further comprising a storage compartment disposed in the knob.

13. The apparatus of claim 1 wherein the placement of the marking device can be adjusted to permit the apparatus to render ovals in either of a clockwise and a counterclockwise direction.

14. The apparatus of claim 13 further including an indicator disposed on the marking device for indicating the direction in which the apparatus is rendering ovals.

15. An apparatus for the rendering of ovals of adjustable ellipticity upon a material having a surface, the apparatus comprising:

a base having a major axis, a minor axis, and a rotatable top portion;

a glide member operatively connected to the base;

an arm disposed for translating through the rotatable top portion;

a swivel plate operatively connected to the top portion wherein the swivel plate is disposed to adjustably lock the arm at a set length; and a marking device operatively connected to the arm.

16. The apparatus of claim 15 wherein the marking device is selected from the group consisting of a cutting blade and a writing implement.

17. The apparatus of claim 15 wherein the marking device comprises a cutting blade and a writing implement.

18. The apparatus of claim 15 wherein the base comprises at least one compass point on each of the major axis and the minor axis.

19. The apparatus of claim 15 wherein the base comprises a channel extending along the minor axis and the glide member is disposed to glide through the channel.

20. The apparatus of claim 15 wherein the base comprises a slot extending along the major axis and the top portion comprises a pin extending downward into the slot wherein the pin rotatably slides through the slot, thereby moving the top portion about the base.

21. The apparatus of claim 20 wherein the base comprises a channel extending along the minor axis co-planar with the slot.

22. The apparatus of claim 20 wherein the base comprises a channel extending along the minor axis, thereby intersecting the slot.

23. The apparatus of claim 15 further comprising a knob mounted on the rotatable top portion.

24. The apparatus of claim 23 further comprising a storage compartment disposed in the knob.

25. The apparatus of claim 15 wherein the placement of the marking device can be adjusted to permit the apparatus to render ovals in either of a clockwise and a counterclockwise direction.

26. The apparatus of claim 25 further including an indicator disposed on the marking device for indicating the direction in which the apparatus is rendering ovals.

27. An apparatus for the rendering of ovals of adjustable ellipticity upon a material having a surface, the apparatus comprising:

a base having a major axis, a minor axis, and a rotatable top portion;

means for adjusting the ellipticity, the means operatively attached to the base and to the top portion;

an arm disposed for translating through the top portion, the arm having a plurality of elongate grooves for adjustable positioning the arm to the apparatus at a set length; and a marking device operatively connected to the arm.

28. The apparatus of claim 27 further comprising a swivel plate for adjustably locking the arm at a set length.

29. The apparatus of claim 27 wherein the marking device is selected from the group consisting of a cutting blade and a writing implement.

30. The apparatus of claim 27 wherein the marking device comprises a cutting blade and a writing implement.

31. The apparatus of claim 27 wherein the base further comprises at least one compass point on each of the major axis and the minor axis.

32. The apparatus of claim 27 wherein the placement of the marking device can be adjusted to permit the apparatus to render ovals in either of a clockwise and a counterclockwise direction.

33. The apparatus of claim 32 further including an indicator disposed on the marking device for indicating the direction in which the apparatus is rendering ovals.

34. An apparatus for the rendering of ovals of adjustable ellipticity upon a material having a surface, the apparatus comprising:

a base having a major axis, a minor axis, and a rotatable top portion having a top surface;

means for adjusting the ellipticity which is operatively attached to the base and to the top portion below the top surface, the means for adjusting the ellipticity comprising a clickerplate operative connected to the base, the clickerplate comprising a plurality of receptacles for receiving a glide member in a rotatably fixed position relative to each receptacles;

an arm disposed for translating through the top portion; and a marking device operatively connected to the arm.

35. The apparatus of claim 34 further comprising a slot extending along the major axis, and a channel extending along the minor axis wherein the glide member is disposed to glide through the channel.

36. The apparatus of claim 35 wherein the top portion comprises a pin extending downward through the clickerplate into the slot wherein the pin rotatably slides through the slot, thereby moving the clickerplate about the base.

37. The apparatus of claim 35 wherein the slot and the channel are co-planar.

38. The apparatus of claim 35 wherein the slot and the channel intersect.

39. The apparatus of claim 34 further comprising a knob mounted on the clickerplate.

40. The apparatus of claim 39 further comprising a storage compartment disposed in the knob.

* * * * *